US006644930B1

(12) United States Patent
Kuismanen

(10) Patent No.: US 6,644,930 B1
(45) Date of Patent: Nov. 11, 2003

(54) METHOD AND ARRANGEMENT FOR PUMPING A MATERIAL USING A DUAL CHAMBER PUMP SYSTEM

(75) Inventor: Esa Kuismanen, Tornio (FI)

(73) Assignee: Oy Pro-Hydro AB, Tornio (FI)

( * ) Notice: Subject to any disclaimer, the term of this patent is extended or adjusted under 35 U.S.C. 154(b) by 0 days.

(21) Appl. No.: 09/958,327

(22) PCT Filed: Apr. 7, 2000

(86) PCT No.: PCT/FI00/00297

§ 371 (c)(1),
(2), (4) Date: Oct. 9, 2001

(87) PCT Pub. No.: WO00/61945

PCT Pub. Date: Oct. 19, 2000

(30) Foreign Application Priority Data

Apr. 9, 1999 (FI) ..... 990780

(51) Int. Cl.[7] ..... F04B 49/00
(52) U.S. Cl. ..... 417/53; 417/393; 417/426
(58) Field of Search ..... 417/53, 46, 393, 417/395, 426

(56) References Cited

U.S. PATENT DOCUMENTS

| | | | | |
|---|---|---|---|---|
| 3,781,141 A | * | 12/1973 | Schall | 417/395 |
| 4,543,044 A | * | 9/1985 | Simmons | 417/342 |
| 4,787,350 A | * | 11/1988 | Syassen | 123/300 |
| 4,844,706 A | * | 7/1989 | Katsuyama et al. | 417/339 |
| 5,269,811 A | * | 12/1993 | Hayes et al. | 623/3 |
| 5,458,468 A | * | 10/1995 | Ye et al. | 417/395 |
| 5,458,470 A | * | 10/1995 | Mannhart et al. | 417/517 |

FOREIGN PATENT DOCUMENTS

| | | | |
|---|---|---|---|
| GB | 2257481 A | * | 1/1993 |
| JP | 61291781 | | 12/1986 |

* cited by examiner

*Primary Examiner*—Charles G. Freay
*Assistant Examiner*—John F. Belena
(74) *Attorney, Agent, or Firm*—Young & Thompson

(57) ABSTRACT

A pumping method and arrangement, in which at least two chamber pumps (A, B) are operated in order to achieve a constant output flow. In the pumping procedure and arrangement, the entry chamber (110, 130) of the chamber pump is pre-pressurised close to the actual working pressure after the filling stage in order to achieve a constant output flow.

20 Claims, 3 Drawing Sheets

METHOD AND ARRANGEMENT FOR PUMPING A MATERIAL USING A DUAL CHAMBER PUMP SYSTEM

BACKGROUND OF THE INVENTION

The object of the invention is a method and arrangement for the pumping of a material used in the industry, such as graphite or a certain partial component of a material composition, in which method the material to be pumped is first pre-pressurised prior to the actual pumping event carried out on the material, in order to balance the yield of the pumping arrangement.

In the steel industry, rolling technology is used to manufacture steel plates, strip, pipes, and various profiles. Oils or other friction reducing lubricants are applied between the rolls and the material to be rolled in order to reduce friction. The use of lubricant and successful lubrication improves the uniformity of the rolling result and prevents the rolls from wearing.

In hot rolling, the temperatures are around +1000° C., and the rolls must often be cooled with ample amounts of water. Thus the oil used as a lubricant will remain on top of the water film and the lubrication result will deteriorate, simultaneously causing problems with the rolling quality. An unevenly rolled steel strip is rolled thinner by cold rolling, but rolling mistakes generated during hot rolling cannot always be corrected by cold-rolling. Thus the product will contain quality faults which mean additional waste costs for the manufacturer.

The U.S. Pat. No. 4,201,070 presents the use of graphite-water solutions in the manufacture of seamless pipes. The U.S. Pat. No. 5,638,893 presents a lubricant system, with which a continual flow of lubricant is achieved, as well as a multitude of nozzles connected to the system, and each of the nozzles can be directed separately. Moreover, it presents a nozzle moving system, which enables continual lubrication, grouping of nozzles into combinations, and automatic cleaning of nozzles at specified intervals. The U.S. Pat. No. 5,090,225 presents a method where oil-water solution is sprayed in the roll gap from both sides of the metal strip.

Laboratory tests have shown the graphite-liquid solution to be a better lubricant in the rolling process than the oil-based lubricant currently in use. The graphite-liquid solution reduces friction better than other lubricants, and its temperature stability is good. The chemical composition of graphite is carbon. The implementation of graphite as a lubricant has been prevented by the strong wear it causes to pumping equipment. In the procedures tested, graphite is sprayed via high-pressure pumping equipment, for example, on the rolling surfaces via several sapphire nozzles in order to spread the graphite evenly. The problem of this procedure is the wear of the pumping equipment parts, because the graphite particles grind the valves and other parts of the equipment. This results in the uneven spraying of graphite and in a greater demand on maintenance, and therefore, in high maintenance and downtime costs. In certain applications, where an exact dosage of partial components is required, excessive gas within the liquid circuits is the problem. Similarly, high pressure existing in certain pumping arrangements expands the flexible pipelines of the arrangement from time to time and causes leakages in packings and gaskets, etc. The above-mentioned adverse factors affecting the volume flow render it more difficult to maintain the yield of the prior art pumping arrangement at a uniform level.

In some industrial applications, the consumption of the material to be pumped is small and, in addition to that, the correct dosage of the material in relation to another partial component to be pumped is critical for the manufacture of the product. For example, in the manufacture of thin, shaped surgical gloves, the proportions of partial components to be sprayed are very accurately determined. The deviation in the mutual proportions of the partial components must not exceed a couple parts in thousand for the product to fulfill the requirements set. The manufacture of such products set very high demands on the pumps used in the processes, and especially on the evenness of their yield with regard to time. The U.S. Pat. No. 4,844,706 presents a procedure where an arrangement of two membrane pumps is used to achieve a uniform yield in the spraying nozzle connected in the system. The membrane pumps are controlled with the help of "OPEN-SHUT" valves controlled by external control logic. The problem with the valves in question is the slowness caused by their structure due to which the pressure only changes after a certain delay after the valve is opened. The U.S. Pat. No. 5,205,722 presents an arrangement where three membrane pumps are used to achieve a uniform yield of the liquid to be pumped. The pumping arrangement is controlled by a partially mechanical rotating cylinder system. It is especially difficult to make the joint yield of the pumps to remain constant in a situation where the pump pumping the liquid to be pumped is replaced by another pump in the pumping arrangement. Replacing a pump in the working phase by another causes a change in the volume flow, which in turn causes decrease in yield in the output circuit which, in some cases, will lead to a deterioration of quality in the end product.

SUMMARY OF THE INVENTION

The objective of the invention is to reduce the above-mentioned adverse effects relating to the prior art.

The pumping method for material in accordance with the invention is characterised by the fact that the pumping arrangement to be pre-pressurised is a chamber pump arrangement in which the entry chamber of the chamber pump between the filling stage and the working stage of the chamber pumps is pre-pressurised with the help of the working liquid to a pressure determined in advance.

The pumping arrangement for material in accordance with the invention is characterised by the fact that the pumping arrangement consists of two adjoined chamber pumping arrangement and their control system.

Some advantageous embodiments of the invention have been presented in dependent patent claims.

The basic idea of the pumping method and arrangement in accordance with the invention is as follows: the pumping arrangement consists of a separate, assisting working liquid circuit and of the pumping circuit of the material to be pumped. Thus the possible wearing, corrosive and other disadvantageous properties of the material to be pumped do not have an influence on the working liquid side. An arrangement of two or more chamber pumps is used for the pumping of material and, in this pumping arrangement, the entry chamber of each chamber pump is subjected to a short pre-pressurising after the filling stage in order to guarantee a uniform yield. The arrangement in accordance with this method may contain several pumping arrangements in accordance with the invention, connected in parallel. This method is suited both for low and high-pressure pumping. Pumping can be monitored and controlled specifically for each operation point, in which case the pumping of liquid remains highly controlled at all times. These properties make the liquid pumping arrangement in accordance with the invention free of maintenance, which means that standstill time in the manufacturing process is significantly reduced.

The advantage of this invention is that it enables the yield of the liquid to be pumped to have significantly smaller variations than methods according to the prior art.

A further advantage of the invention is the fact that a pumping arrangement in accordance with the invention is able to pump highly wearing liquid solutions dozens of times longer than prior art pumping arrangements before maintenance is required. Thus significant savings in costs can be achieved in the heavy metal industry.

Another advantage of the invention is the fact that a certain embodiment of the pumping arrangement can be used in applications where a part of the equipment/parts of the process are energised to more than 100 kV.

BRIEF DESCRIPTION OF THE DRAWINGS

A detailed description of the invention is given in the following. The description refers to the attached drawings where.

DESCRIPTION OF THE PREFERRED EMBODIMENTS

Figure 1:
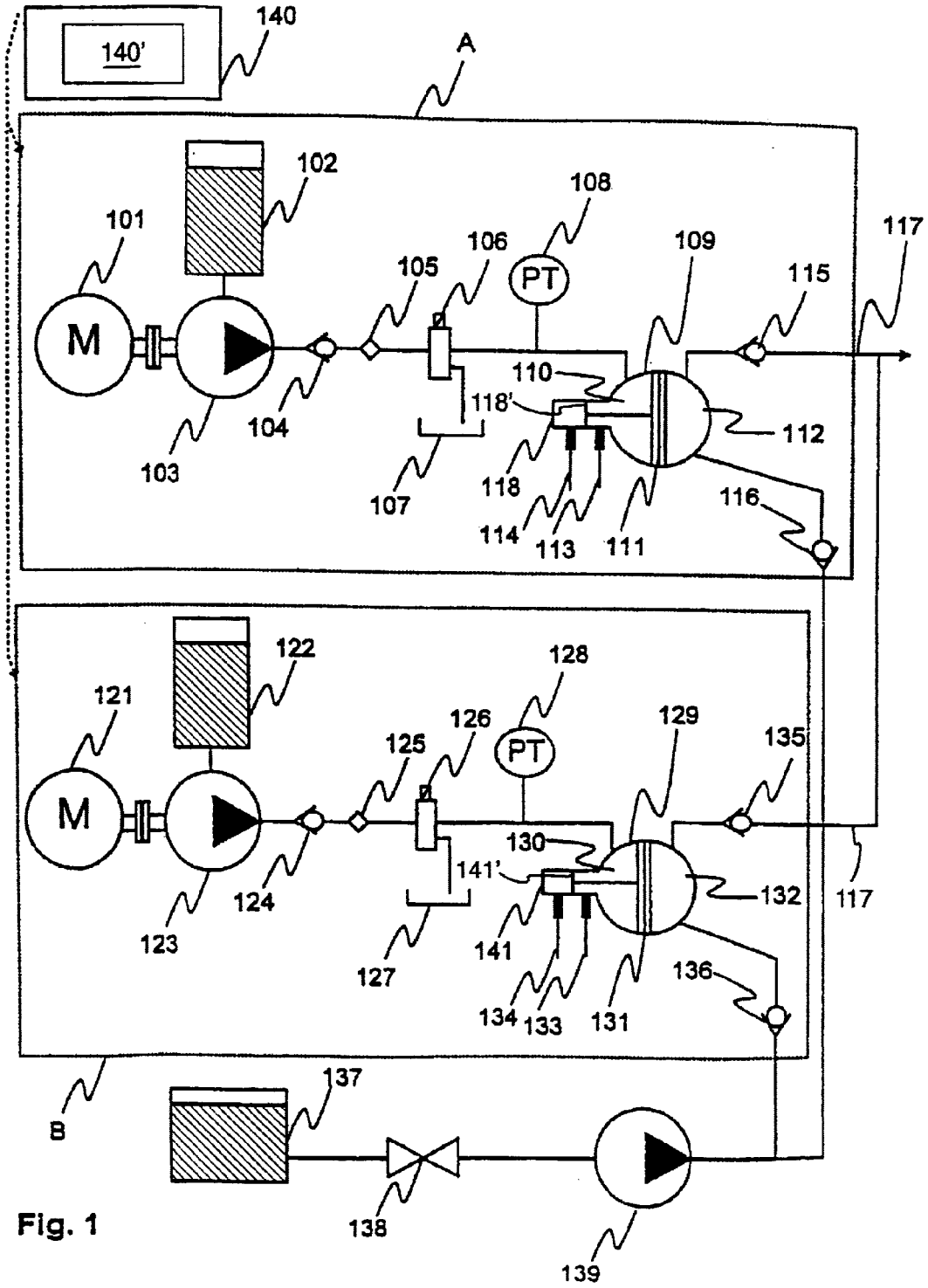
FIG. 1 depicts, as an example, the embodiment which is used in the pumping of graphite-liquid solution.

FIG. 1 shows, as an example, a principle drawing of the pumping arrangement where the pumping method in accordance with the invention has been used. The pumping arrangement consists of two chamber pump systems which are alike: pumping arrangement A, reference numbers 101 to 116 of the figure, and pumping arrangement B, reference numbers 121 to 136, and of a joint feeding system of the material to be pumped, reference numbers 137 to 139, as well as of a control system for the pumping arrangement, reference number 140. In the embodiment of the FIG. 1, the operation of the pumping arrangements A and B is synchronised with one another in order to guarantee a uniform, pulse-free yield. Both pumping arrangements, A and B, consist of two liquid circuits. The first circuit, 101 to 110, 121 to 130, where the working liquid flows, is later on referred to as the working liquid circuit. The other circuit, 112 to 115, 132 to 135, as well as 137 to 139, where the material to be pumped (which advantageously in a certain embodiment is a graphite-liquid solution) flows, is later on referred to as the pumping circuit.

The parts of the pumping arrangement A and their operation are described in the following. The parts of the pumping arrangement B are alike, but its operation takes place in different stages, as described in the explanation to the FIG. 3. In the pumping arrangement A, the working liquid is pumped from the container 102 through a standard flow pump 103 via a feed line to the chamber pump 109. The pump 103 is operated with the motor 101. A non-return valve 104 is located in the line after the pump 103 to prevent the working liquid from flowing back to the pump when the pump is not working. After the valve 104 there is a flow indicator 105 in the line, followed by a seat-type control valve 106, through which the working liquid is directed to the chamber pump 109 or returned to the working liquid circuit via the receiver container 107. After the control valve 106 there is a pressure-measuring device 108 for the measurement of the pressure in the entry chamber 110 of the chamber pump. The material to be pumped is fed from the container 137 through the valve 138 to the feed pump 139 and from there through the gravitational non-return valve 116 to the exit chamber 112 of the chamber pump 109, when the pump in question is in the filling stage. The material to be pumped from the exit chamber 112 of the chamber pump 109 is fed during the working stage of the pump through the gravitational non-return valve 115 to the line 117, along which the material is directed to the specific operation point in question. The line of the material to be pumped by the second chamber pump 129 is also connected to the same line 117. A measuring instrument 118' for the location of the membrane, located in the protective pipe 118, is attached to the membrane 111 of the chamber pump 109; the measuring instrument 118' is favourably a piston-like body, whose end positions are perceived by the sensor bodies 113 and 114 attached to the protective pipe. The protective pipe 118 is dimensioned so loosely that the working liquid is able to fill the entire volume of the protective pipe. Thus the sensor bodies 113 and 114 are able to observe the working stage position of the membrane 111. The data received from the sensor bodies 113 and 114 is used for the control of the pump 103 and the valves 106 and 138. The pumping arrangement also includes a control system 140 which observes/controls the motors, valves and pressure measuring devices of the pumps.

The overall yield of the material to be pumped is adjusted by the pumping arrangement where the material is pumped with the help of the pumping arrangements A and B through the line 117 to the operation target. A feeding line of the material to be pumped comes from the container 137 to the exit chamber 112 of the chamber pump 109 in the pumping arrangement A. In the feeding line, the flow to the chamber pump 109 is controlled by the non-return valve 116, enabling the flow of the material to be pumped from the container 137 to the exit chamber 112 of the chamber pump 109 only in the filling stage of the chamber pump 109 in question. There is a line 117 leading from the exit chamber 112 of the chamber pump 109 through the non-return valve 115 to the operation target. The feeding line of the material to be pumped coming from the pumping arrangement B is also connected to the line in question.

The movement of the membrane 111 in the chamber pump 109 is directed advantageously with the pressure difference existing in the working liquid circuit and the pumping circuit. When the pressure on the side of the entry chamber 110 of the chamber pump 109 is greater than the pressure in the exit chamber 112, the chamber pump 109 is in the working stage, i.e. the membrane is moving the material to be pumped through the non-return valve 115 to the line 117. The volume flow of the material to be pumped is maintained constant by adjusting the rotational speed of the standard volume pump 103 located in the working liquid circuit in such a way that the volume flow of the working liquid circuit remains constant. When the pressure of the exit chamber 112 of the chamber pump 109 is greater than the pressure in the entry chamber 110, i.e. the chamber pump 109 is in the filling stage, the membrane 111 in the chamber pump 109 moves to the direction, in which the material to be pumped is flowing from the container 137 to the exit chamber 112. In this case, only a flow from the container 137 via the non-return valve 116 to the exit chamber 112 of the chamber pump 109 is allowed.

The pressure difference on the different sides of the membrane is controlled with the help of the pumps 103, 123 and 139 in such manner that the chamber pump 109 and 129 alternate in working and filling stages. When one of the chamber pumps 109 and 129 come to the working stage, the flow of the material to be pumped to the working stage from the exit chamber of the chamber pump in question opens the non-return valve following the exit chamber of the chamber pump in question. The other chamber pump is simultaneously reaching the end of its working stage, in which case the standard volume pump located in the working liquid circuit of the other chamber pump in question is stopped. As a result, the non-return valve after the other chamber pump in question is closed gravitationally during a couple of seconds. When the non-return valve in question has closed, the other chamber pump in question moves to the filling stage, in which case the exit chamber of the other chamber pump in question is filled with the material to be pumped. In other advantageous embodiment, a spring or a working cylinder is attached to the membrane of the chamber pumps 109 and 129, and it is used to help the membrane 111, 131 during the filling stage to return to the starting position of the working stage.

After the completion of the filling stage of the chamber pump, pre-pressurising in accordance with the invention is carried out. Pre-pressurising is achieved by rotating the standard volume pump 103, 123 as long as it takes to achieve the desired pressure in the entry chamber 110, 130 of the chamber pump 109, 129. After this, the standard volume pump is stopped, and the gravitationally operating non-return valves located in the feeding line of the working liquid close, and thus prevent a pressure decrease in the entry chamber 110, 130 of the chamber pump 109, 129. The cycles of the working and filling stages for the pumps A and B are presented in more detail in connection with the description to the FIG. 3.

The example pumping arrangement in the FIG. 1 consists of the membrane location sensor bodies 113, 114 and 133, 134, located in the protective pipe 118, 141 of the measuring body attached to the membrane 111, 131 of the chamber pump 109, 129; with the sensor bodies and measuring instruments 118' and 141' it is possible to observe the various operational positions of the membrane 111, 131. The sensor bodies can be realised in several different manners. Advantageously they can be either galvanic, inductive, electrostatic, or optical identification elements. In FIG. 1, when the membrane 111 of the chamber pump 109 has achieved the end stage of the working stage, the sensor body 113 gives a signal which is directed to the control system 140 of the pumping arrangement. The control system gives a stopping command to the motor 101 of the standard volume pump 103 of the pumping arrangement A. Simultaneously, the seat valve 106 located in the line connected to the pumping arrangement A is given a command to move into a position in which the flow of the working liquid is also allowed to the container line 107, and from there, to the container 102. Simultaneously, the control system gives the motor 121 of the standard volume pump 123 of the pumping arrangement B a command to start, and similarly, the seat valve 126 is given the command to move into a position, in which it no longer allows the working liquid to flow into the container 102. When the pressure is increased to an adequate level in the entry chamber 130 of the chamber pump 129, the pumping of the material to be pumped is transferred from the chamber pump 109 to the chamber pump 129 in the manner described above.

The pumping arrangement and its working liquid circuit in the FIG. 1 are suited for applications requiring a larger pumping capacity and good uniformity of the exit flow, for example, for pumping arrangement which pump a graphite-liquid solution. The working liquid comes from the containers 102, 122, from which it is pumped with the standard volume pump 103, 123 to the entry chamber 110, 130 of the chamber pumps 109, 129. The pump 103, 123 is operated with a motor 101, 121, which in turn is controlled by frequency transformer 140'. Seat valves 106, 126 are also controlled with the earlier mentioned control system 140. The data given by the pressure measuring devices 108, 128 is utilised in the control of the pumping arrangements A and B, and in the generation of pre-pressurisation in a manner to be presented later.

Figure 2:
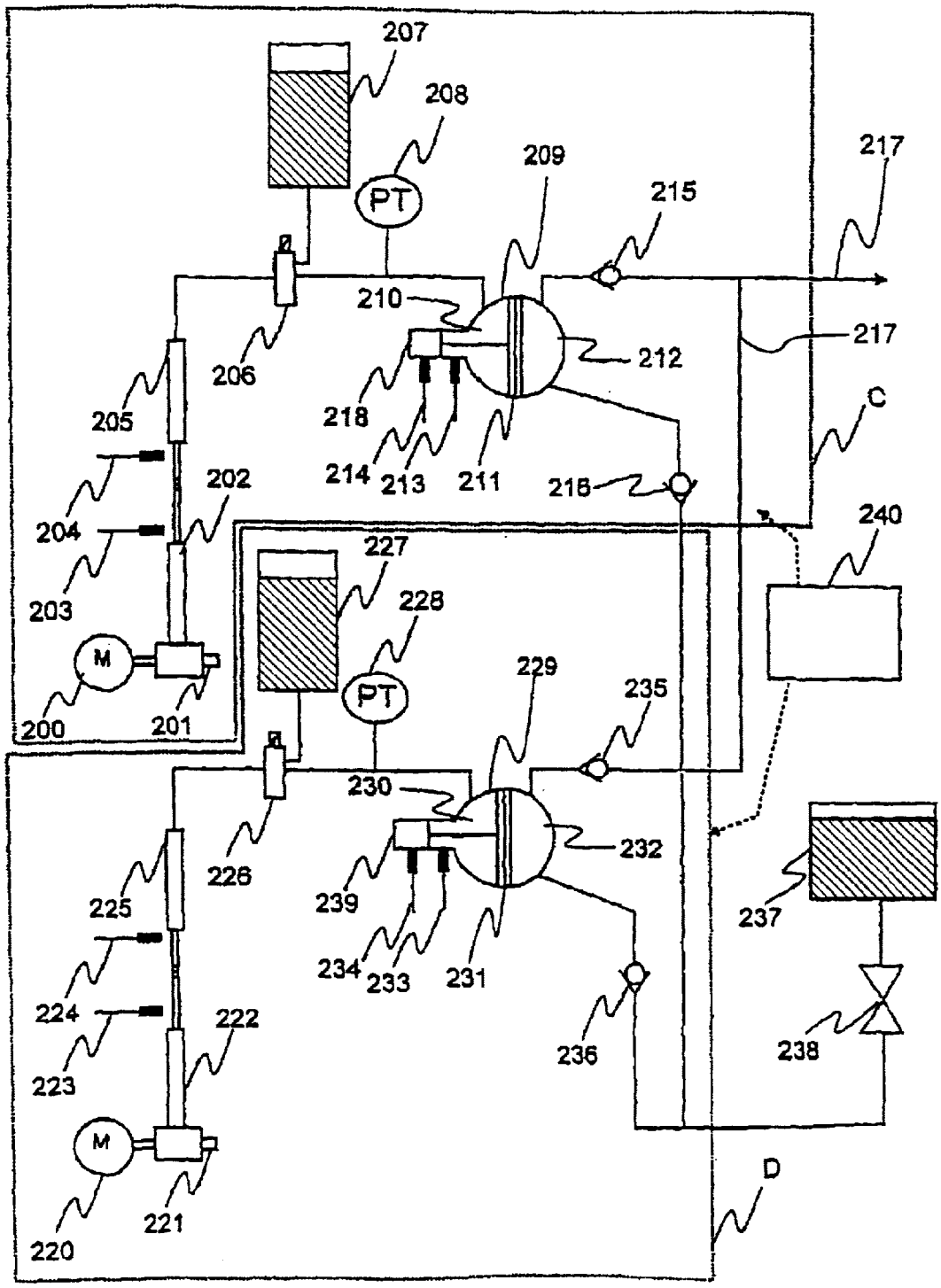
FIG. 2 depicts, as an example, the embodiment which is used in painting systems based on static electric charge.

FIG. 2 presents an advantageous embodiment of the invention which is utilised in applications which require a very precise control of the exit flow of pumping. In the pumping circuit, the material to be pumped (which may be electrostatic painting liquid) is received from the container 237, from which a material feeding line leads to the exit chamber 212, 232 of the chamber pump 209, 229 of the chamber pump arrangement C and D, in a manner presented in conjunction with the explanation to the FIG. 1 with the exception that there is no separate pump in the line from the storage container 237 to the chamber pumps via the valve 238, but the material to be pumped is transferred to the exit chamber of the chamber pump with the help of gravity/low pressure via the gravitationally operating non-return valve 216, 236. In the working stage of the chamber pump, operation is the same as described in the explanation to the FIG. 1. The liquid to be pumped flows along the feeding line 217 from the chamber pumps to the operational target.

In the embodiment of the FIG. 2, the working liquid circuit is altered as follows in order to achieve a very good pressure control at the exit flow of the pumping arrangement. Parts of the working liquid circuit of the pumping arrangement C and their operation are described in the following. The parts of the pumping arrangement D are corresponding, but its operation takes place in different stages, as presented in the explanation to the FIG. 3. The working liquid circuit contains the stepping motor with its gearbox 200 and the adjoined tachogenerator 201, spindle motor 202 with the spindle, spindle position sensor bodies 203 and 204, piston pump 205 connected to the spindle, seat valve 206 located in the line after the piston pump, working liquid container 207, pressure measuring device 208, as well as the entry chamber 210 of the chamber pump 209. In the embodiment in question, the working liquid is not circulated, but it moves from the piston pump 205 via the seat valve 206 to the entry chamber 210 of the chamber pump 209 during the working stage, and returns when the chamber pump is in the filling stage by altering the direction of motion of the piston in the piston pump which, in turn, is effected by changing the direction of rotation of the spindle motor. The signal received from the tachogenerator 201 is utilised in the control system 240 for the control of the speed and direction of rotation of the stepping motor 200 of the pumping arrangement C. Similarly, the operational position of the valve 206 is controlled with the help of the control system 240.

In the pre-pressurisation in accordance with the invention, the stepping motor 200 is rotated as long as the desired pressure is achieved in the entry chamber 210 of the chamber pump 209. Since the stepping motor 200 is stopped, neither the piston of the piston pump 205 is moving, and thus it is possible to maintain the pressure in the entry chamber 210 of the chamber pump 209 at the desired level up to the beginning of the working stage. When necessary, more working liquid may be taken from the container 207, or also the amount of working liquid may be reduced. The seat valve 206 is also utilised as a removal body for the gas in the working liquid in the manner described in more detail in conjunction with the explanation to FIG. 3.

The flow channel from the piston pump to the valve is arranged in such a way that during the filling stage of the chamber pump arrangement in question, gas contained in the working liquid will be accumulated in such a part of the seat valve, from which it can be directed to the storage container 207. When the gas, of which the working liquid may contain several percent, is successfully removed from the working liquid in a controlled manner, the working liquid no longer can be compressed, and thus the pressure control in the entry chamber of the chamber pump is good. With this method, the prevailing pressure differences in the entry chambers of the chamber pumps of the pumping arrangement can be controlled better than with arrangement in accordance with the prior art technology.

The position sensor bodies 213 and 214 of the membrane 211 located in the chamber pump 209 can be realised in a number of different ways. Galvanic, inductive, electrostatic, or also optical identification elements can be connected to the protective pipe 218, 239 of the measuring body. In one advantageous embodiment, optical identification elements can be used, in which case the membrane pump itself and the material to be pumped can be galvanically separated from the rest of the pumping arrangement. Such applications are, for example, painting methods based on the static electrical charge of the material. With these methods, the charging voltages of the paint material to be used may exceed 100 kV, in which case a galvanic separation of the device is important for operational safety purposes alone.

The pumping arrangements described in FIGS. 1 and 2 can be connected several pieces to operate in parallel manner. In that case they can be utilised in applications, in which several partial components are mixed into one operational target, or in which the material to be pumped must be sprayed simultaneously on a large surface.

Figure 3:
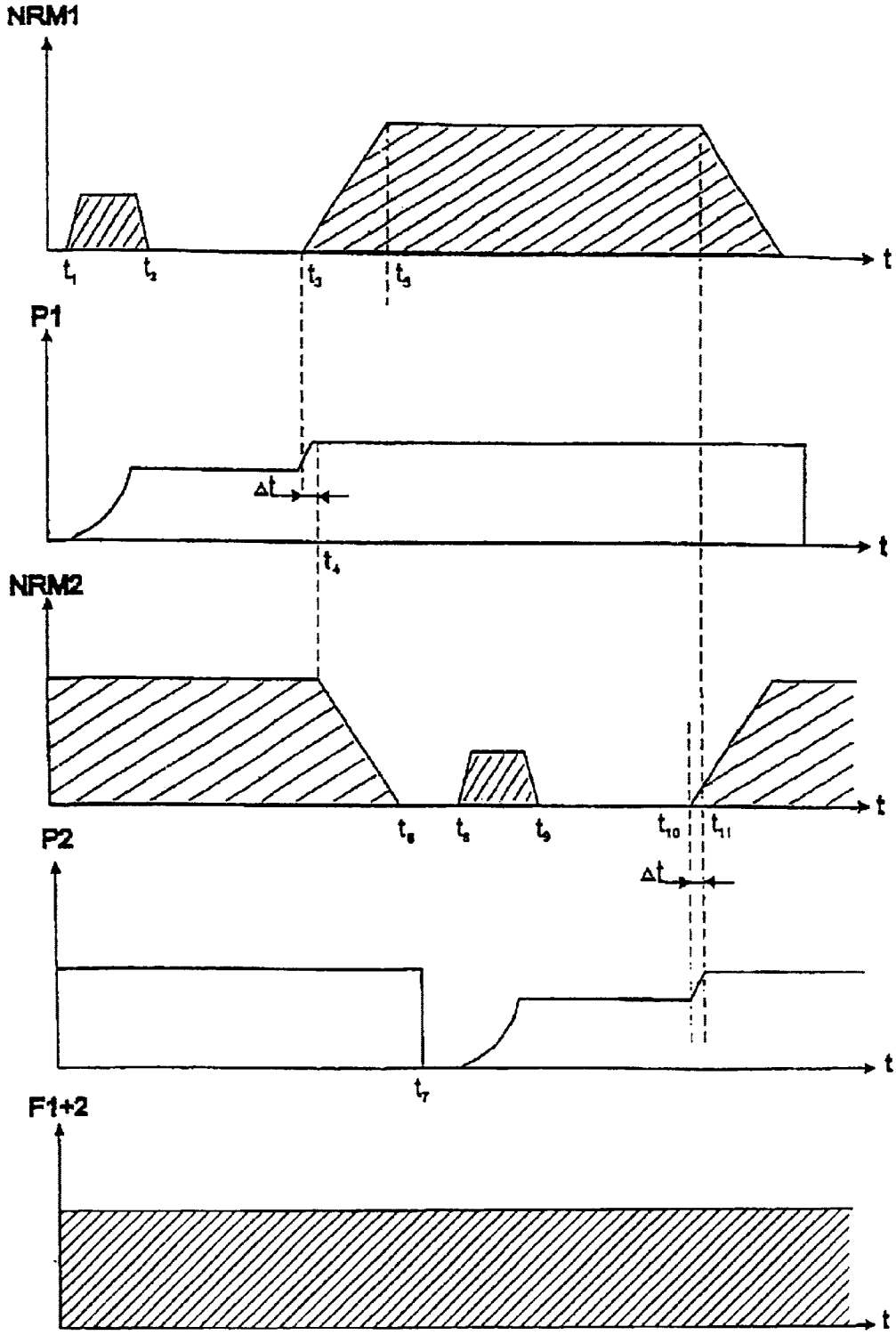
FIG. 3 depicts the behaviour of the pressure in the pumping arrangement as a rotation speed-pressure-time chart, measured from the working liquid circuit.

The pre-pressurisation utilised in the pumping arrangement in accordance with the invention, its timing and influence on the exit flow of the pumping arrangement A, B or C, D is presented in the FIG. 3 by utilising the reference numbering of the pumping arrangement A, B of the FIG. 1. The time axis used only refers to the sequence of the events, not to the exact duration of different events. For example, the pre-pressurisation used in the pumping arrangement may last only some milliseconds at its shortest, and the actual working stage may last dozens of seconds. The FIG. 3 shows, in chronological order, the revolutions of the motor NRM1 of the standard volume pump 103 in the working liquid circuit of the pumping arrangement A, the pressure P1 of the entry chamber 110 or the chamber pump 109, the revolutions of the motor NRM2 of the standard volume pump 123 in the working liquid circuit of the pumping arrangement B, the pressure P2 of the entry chamber 130 or the chamber pump 129, and the exit flow F1+2 in the line 117 leaving from the pumping arrangement.

The time chart starts with the moment $t_1$, in which the chamber pump 129 is responsible for the pumping of the material to be pumped in the pumping arrangement.

In this case, the motor of the standard volume pump 123 is turning with the standard speed NRM2 in accordance with the set value, as seen in the time chart figure, generating a standard volume flow in the working liquid circuit. The pressure P2 of the entry chamber 130 or the chamber pump 129 remains at the desired standard level, which leads to a movement by the membrane 131 in a direction which makes the material to be pumped to flow from the exit chamber of the chamber pump 129 to the line 117.

At the moment $t_1$, the filling stage of the other chamber pump 109 has already been completed, and the exit chamber 112 of the chamber pump 109 is full of the material to be pumped. At the moment $t_1$, the motor of the standard volume pump 103 is started. The revolutions of the motor NRM1 are controlled to the desired level, which is lower than the motor revolutions used in the actual working stage. As a result of this measure carried out, the pressure in the entry chamber 110 of the chamber pump 109 is increasing in accordance with the diagram P1. At the moment $t_2$, the motor of the standard volume pump 103 is stopped, and the diagram shows that the pressure in the entry chamber 110 of the chamber pump 109 remains below the pressure level used in the working stage. Since the pre-pressurisation pressure P1 (40% to 90% or 95% of the working pressure) remains clearly lower than the pressure used in the actual working stage, which exists in the line 117 due to the working stage of the chamber pump 129, the non-return valve 115 after the chamber pump 109 does not open during the pressure-pressurisation. In turn, the non-return valve 104 prevents the working liquid from flowing backwards, when the standard volume pump 103 is stopped at the moment $t_2$. Thus the pressure can be maintained unchanged in the entry chamber 110 of the chamber pump 109 up to the moment $t_3$. In case it is noted that the pressure changes between the moments $t_2$ and $t_3$, it indicates a leakage somewhere in the pumping system which must be found and repaired.

Thus the pressure adjustment also operates as a fault indicator. At the moment $t_3$, the chamber pump 129 approaches the end of its working stage. At the moment $t_3$, the control system starts the motor of the standard volume pump 103 and controls it to rotate at the speed required by the working stage. Because the pressure existing in the entry chamber 110 of the chamber pump 109 already is almost the pressure required during the working stage, the actual working stage pressure is achieved in a controlled manner and quickly during the time $\Delta t$ ($\Delta t = t_4 - t_3$), as shown in the diagram P1. The time $\Delta t$ in question can be determined on the basis of the application to be used, starting from 1 ms and lasting up to several seconds. The speed of the pressure control is determined in such a way that the target pressure is achieved quickly and with as little vibration as possible.

At the moment $t_4$, the pressure of the entry chamber 110 of the chamber pump 109 is at the desired pressure level of the working stage. At the same moment $t_4$, the control system starts to slow down the revolutions of the standard volume pump 123. At the moment $t_5$, the standard volume pump 103 rotates at the set speed generating the standard volume flow within the working liquid circuit from the pump 103 to the entry chamber 110 of the chamber pump 109. At the moment $t_6$, the standard volume pump 123 stops, which at the moment $t_7$ results in the decrease of the pressure in the exit chamber 132 of the chamber pump 129 and the gravitational non-return valve 135 closes and the pumping work is transferred for the chamber pump 109, because the non-return valve 115 has opened. In the time frame $t_5$ to $t_{11}$, the chamber pump 109 continues to the working stage. At the same time, the chamber pump 129 is in the filling stage, in which the exit chamber 132 of the chamber pump 129 is filled with the material to be pumped. Between the moments $t_8$ and $t_9$, the entry chamber 130 of the chamber pump 129 is subject to pre-pressurisation in the same manner as it was carried out with the chamber pump 109 during the moments $t_1$ and $t_2$. At the moment $t_9$, the pre-pressurisation is completed and the standard volume pump 123 is stopped. At the moment $t_{10}$, the standard volume pump 123 is started, in order to be able to transfer the pumping work back to the chamber pump 129. From this point onwards, the operation is repeated with the pumping arrangement B in the same way as it is described for the pumping arrangement A to take place during the moments $t_3$ to $t_{11}$.

The embodiment described by the FIG. 2 follows the same time chart as the embodiment of the FIG. 1, however with the following exceptions. In FIG. 3, the pump revolutions described stand for the working stage revolutions of the two spindle motors 200, 220 operating the piston pump. Moreover, the cylinder, flow line and valve 206, 226 of the piston pump 205, 225 have been arranged so that the line directing to the valve from the working cylinder of the piston pump is constantly rising. Thus the gas mixed with the working liquid is collected in the valve 206, 226, from where it can be removed at the beginning of both the filling stage and the pre-pressurising stage $t_1$ to $t_2$ to the container 207, 227. When the gas has been successfully removed to the container 207, 227, the channel leading to the container is closed. Otherwise, the filling stage of the pumping arrangement, the pre-pressurisation of the entry chamber and the working stage follows one another according to the explanation to the pumping arrangement in accordance with the FIG. 1.

The control system 140, 240 relating to the pumping arrangement not only takes care of the control of the motors and valves of the pumps, but also of the storing and processing of the data received from pressure measurements. The control system gives an alarm, in case the pressure behaviour of the pumping arrangement changes during the operation in some way. Thus it is possible to anticipate and prevent the operation of a pumping arrangement about to get broken. This way it is also possible to prevent the manufacture of products with poor quality, and to reduce additional costs occurring in the manufacturing process.

In the above, some very advantageous embodiments of the invention have been described. For a person skilled on the art, it is clear that also other types of solutions can be realised in the framework of this invention idea and of the patent claims. For example, the pumping arrangement can be utilised as a casting machine for a casting piece requiring several partial components.

What is claimed is:

1. A method for pumping a material with a first diaphragm pump having an entry chamber that receives a working liquid and a pumping chamber that receives the material to be pumped, where the entry chamber and the pumping chamber are separated by a movable membrane, the method comprising the steps of:

increasing a pressure in the entry chamber and the pumping chamber during a filling stage when the pumping chamber is not pumping the material to be pumped by pumping the working liquid into the entry chamber until the pressure in the entry chamber reaches a predetermined pre-pressure that is less than a working pressure of the entry chamber; and after the filling stage, further increasing the pressure in the entry chamber and the pumping chamber to the working pressure during a working stage when the pumping chamber is pumping the material to be pumped from the pumping chamber by pumping the working liquid into the entry chamber.

2. The method of claim 1, further comprising the step of maintaining the pressure in the entry chamber at the pre-pressure after the filling stage until the step in which the pressure in the entry chamber is further increased.

3. The method of claim 1, further comprising the step of not pumping the working liquid into the entry chamber after the filling stage until the step in which the pressure in the entry chamber is further increased.

4. The method of claim 1, wherein the pre-pressure is 40% to 95% of the working pressure.

5. The method of claim 1, wherein the pre-pressure is maintained in the entry chamber for a period of 1 ms to 10,000 ms.

6. The method of claim 1, further comprising the steps of pumping the material with a second diaphragm pump that operates the same as the first diaphragm pump and whose output is connected to an output from the first diaphragm pump, wherein the filling stage of the second diaphragm pump is during the working stage of the first diaphragm pump and the filling stage of the first diaphragm pump is during the working stage of the second diaphragm pump.

7. A pump for pumping a material, comprising:

two diaphragm pumps that each have an entry chamber that receives a working liquid and a pumping chamber that pumps the material to a common outlet, where the entry chamber and the pumping chamber are separated by a movable membrane; and a controller that increases a pressure in the entry chamber of one of said two pumps until reaching a predetermined pre-pressure less than a working pressure of the pump while the other of said two pumps is pumping the material from the respective pumping chamber to the common outlet at the working pressure.

8. The pump of claim 7, wherein said controller maintains the pressure in the entry chamber at the pre-pressure until the pressure in the entry chamber is further increased to the working pressure.

9. The pump of claim 7, wherein said controller stops pumping the working liquid into the entry chamber after the pre-pressure has been reached until the pressure in the entry chamber is further increased to the working pressure.

10. The pump of claim 7, wherein said controller controls the pre-pressure to 40% to 95% of the working pressure.

11. The pump of claim 7, wherein said controller maintains the pre-pressure in the entry chamber for a period of 1 ms to 10,000 ms.

12. The pump of claim 7, further comprising separate non-return valves between the pumping chamber of each of said two pumps and said common outlet.

13. The pump of claim 12, wherein said non-return valves permit flow of the material from said two pumps to said common outlet at the working pressure but not at the pre-pressure.

14. A pump for pumping a material, comprising:

a first diaphragm pump having a first entry chamber that receives a working liquid and a first pumping chamber that receives the material, said first entry chamber and said first pumping chamber being separated by a first movable membrane;

a second diaphragm pump having a second entry chamber that receives a working liquid and a second pumping chamber that receives the material, said second entry chamber and said second pumping chamber being separated by a second movable membrane;

a common outlet connected to said first and second pumping chambers; and a controller that (a) increases a pressure in said first entry chamber and said first pumping chamber during a first filling stage when said first pumping chamber is not pumping the material and said second pumping chamber is pumping the material by pumping the working liquid into said first entry chamber until the pressure in said first entry chamber reaches a predetermined pre-pressure that is less than a working pressure, (b) after the first filling stage, further increases the pressure in said first entry chamber and said first pumping chamber to the working pressure during a first working stage when said first pumping chamber is pumping the material from said first pumping chamber to said common outlet by pumping the working liquid into said first entry chamber, (c) increases a pressure in said second entry chamber and said second pumping chamber during a second filling stage when said second pumping chamber is not pumping the material to be pumped during said first working stage by pumping the working liquid into said second entry chamber until the pressure in said second entry chamber reaches a predetermined pre-pressure that is less than the working pressure, and (d) after the second filling stage, further increases the pressure in said second entry chamber and said second pumping chamber to the working pressure during a second working stage when said second pumping chamber is pumping the material from said second pumping chamber to said common outlet by pumping the working liquid into said second entry chamber.

15. The pump of claim 14, wherein said controller maintains the pressure in said first entry chamber at the pre-pressure until the pressure in said first entry chamber is further increased to the working pressure, and maintains the pressure in said second entry chamber at the pre-pressure until the pressure in said second entry chamber is further increased to the working pressure.

16. The pump of claim 14, wherein said controller stops pumping the working liquid into said first entry chamber after the pre-pressure has been reached until the pressure in said first entry chamber is further increased to the working pressure, and stops pumping the working liquid into said second entry chamber after the pre-pressure has been reached until the pressure in said second entry chamber is further increased to the working pressure.

17. The pump of claim 14, wherein said controller controls the pre-pressure to 40% to 95% of the working pressure.

18. The pump of claim 14, wherein said controller maintains the pre-pressure in said first and second entry chambers for a period of 1 ms to 10,000 ms.

19. The pump of claim 14, further comprising a first non-return valve between said first pumping chamber and said common outlet and a second non-return valve between said second pumping chamber and said common outlet.

20. The pump of claim 19, wherein said first and second non-return valves permit flow of the material to said common outlet at the working pressure but not at the pre-pressure.

* * * * *